US011195487B2

(12) United States Patent
Liu

(10) Patent No.: US 11,195,487 B2
(45) Date of Patent: Dec. 7, 2021

(54) DISPLAY DRIVING CIRCUIT

(71) Applicant: SITRONIX TECHNOLOGY CORP., Jhubei (TW)

(72) Inventor: Chih-Hao Liu, Jhubei (TW)

(73) Assignee: Sitronix Technology Corp., Jhubei (TW)

( * ) Notice: Subject to any disclaimer, the term of this patent is extended or adjusted under 35 U.S.C. 154(b) by 0 days.

(21) Appl. No.: 16/733,833

(22) Filed: Jan. 3, 2020

(65) Prior Publication Data

US 2020/0388236 A1 Dec. 10, 2020

Related U.S. Application Data

(60) Provisional application No. 62/787,822, filed on Jan. 3, 2019.

(51) Int. Cl.
*G09G 3/36* (2006.01)

(52) U.S. Cl.
CPC ..... *G09G 3/3677* (2013.01); *G09G 3/3688* (2013.01); *G09G 2310/0289* (2013.01); *G09G 2310/08* (2013.01); *G09G 2320/0233* (2013.01)

(58) Field of Classification Search
None
See application file for complete search history.

(56) References Cited

U.S. PATENT DOCUMENTS

| | | | | |
|---|---|---|---|---|
| 7,825,881 | B2 | 11/2010 | Shin | |
| 9,786,384 | B2 | 10/2017 | Lee et al. | |
| 2016/0118000 | A1* | 4/2016 | Kim | G09G 3/3688 345/691 |
| 2017/0004792 | A1 | 1/2017 | Deng et al. | |
| 2018/0315388 | A1* | 11/2018 | Han | G09G 3/3688 |

FOREIGN PATENT DOCUMENTS

| | | | |
|---|---|---|---|
| CN | 1819006 | A | 8/2006 |
| CN | 101996562 | A | 3/2011 |
| CN | 102201216 | A | 9/2011 |
| CN | 102610206 | A | 7/2012 |
| CN | 102867492 | A | 1/2013 |
| CN | 105551445 | A | 5/2016 |
| CN | 106652954 | A | 5/2017 |
| CN | 107591123 | A | 1/2018 |
| CN | 107885397 | A | 4/2018 |
| CN | 107958653 | A | 4/2018 |
| CN | 108962120 | A | 12/2018 |
| TW | 201131540 | A | 9/2011 |

OTHER PUBLICATIONS

Office Action issued by Foreign Patent Office dated Jun. 2, 2021 for corresponding TW Application No. 202010007030.0.

(Continued)

*Primary Examiner* — Christopher J Kohlman
(74) *Attorney, Agent, or Firm* — Rosenberg, Klein & Lee

(57) ABSTRACT

The invention relates to a display driving circuit, which comprises a gate driving circuit and a source driving circuit. The gate driving circuit outputs a plurality of gate signals. The source driving circuit outputs a plurality of source signals and changes the levels of the source signals when the levels of the gate signals are a turn-off level.

9 Claims, 5 Drawing Sheets

(56) References Cited

OTHER PUBLICATIONS

Office Action (I) issued by Foreign Patent Office dated Jan. 3, 2019 for corresponding TW Application No. 109100247.
Office Action issued by Foreign Patent Office dated Dec. 4, 2019 for corresponding TW Application 109100247.
Office Action (II) issued by Foreign Patent Office dated Jan. 3, 2019 for corresponding TW Application 109100247.
Office Action issued by Foreign Patent Office dated Jun. 25, 2021 for corresponding TW Application 109100247.

* cited by examiner

DISPLAY DRIVING CIRCUIT

FIELD OF THE INVENTION

The present invention relates to a display driving circuit, and particularly to a display driving circuit capable of reducing leakage current.

BACKGROUND OF THE INVENTION

As wearable and portable products develop, for the sake of low power consumption, it is generally expected that thin-film transistor liquid-crystal displays are operated at a lower frequency. Unfortunately, when displays are operating in the low frequency, the threshold voltages of transistors will shift due to the long-term stress on the transistors. Consequently, the turning on and off the transistors might deviate from the design and hence leading to inferior display quality. In addition, when the transistors in pixels are turned off, the leakage currents flowing though the transistors will lower the storage voltage, resulting in the problems of flickers or color inconsistency.

Accordingly, the present provides a display driving circuit, and particularly a display driving circuit capable of reducing leakage current.

SUMMARY

An objective of the present invention is to provides a display driving circuit for reducing the leakage current of the display device.

The present invention relates to a display driving circuit, which comprises a gate driving circuit and a source driving circuit. The gate driving circuit outputs a plurality of gate driving signals. The source driving circuit outputs a plurality of source signals and changes the levels of the source signals when the levels of the gate signals are a turn-off level.

DETAILED DESCRIPTION

In the specifications and subsequent claims, certain words are used for representing specific devices. A person having ordinary skill in the art should know that hardware manufacturers might use different nouns to call the same device. In the specifications and subsequent claims, the differences in names are not used for distinguishing devices. Instead, the differences in functions are the guidelines for distinguishing. In the whole specifications and subsequent claims, the word "comprising" is an open language and should be explained as "comprising but not limited to". Besides, the word "couple" includes any direct and indirect electrical connection. Thereby, if the description is that a first device is coupled to a second device, it means that the first device is connected electrically to the second device directly, or the first device is connected electrically to the second device via other device or connecting means indirectly.

Figure 1:
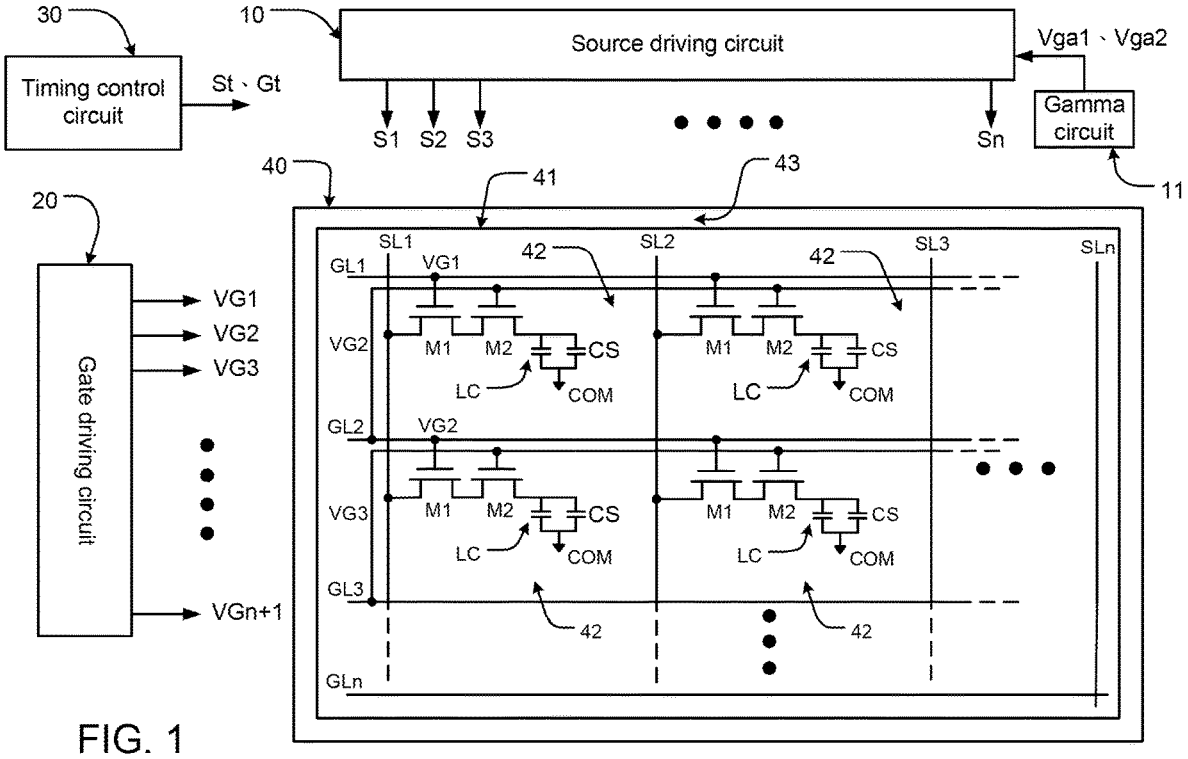
FIG. 1 shows a circuit diagram of the display driving circuit driving the display region according to an embodiment of the present invention.

Please refer to FIG. 1, which shows a circuit diagram of the display driving circuit driving the display region according to an embodiment of the present invention. As shown in the figure, the display driving circuit comprises a source driving circuit 10 and a gate driving circuit 20. The display driving circuit is coupled to a plurality of pixels 42 located in a display region 41 of a display panel 40. The display panel 40 includes a plurality of gate lines GL1, GL2, GL3 . . . GLn and a plurality of source lines SL1, SL2, SL3 . . . SLn. The display panel 40 includes the display region 41 and a non-display region 43. The source driving circuit 10 and the gate driving circuit 20 are coupled to the pixels 42 via the source lines SL-SLn and the gate lines GL1-GLn, respectively, and output a plurality of source signals S1, S2, S3 . . . Sn and a plurality of gate signals VG1, VG2, VG3 . . . VGn+1 to the pixels 42 located in the display region 41 of the display panel 40, respectively, for controlling the display region 41 to display an image. The pixels 42 include a plurality of transistors M1, M2. To reduce the leakage current of the transistors M1, M2, after the display region 41 refreshes, namely, after the display region 41 updates and displays new image, the levels of the gate signals VG1-VGn+1 are a turn-off level and the source driving circuit 10 changes the levels of the source signals S1-Sn. Take black-white grayscale displaying for example, the level of each of the source signals S1-Sn is a first level or a second level. Thereby, when the levels of the gate signals VG1-VGn+1 are a turn-off level, the source driving circuit 10 may change the levels of the source signals S1-Sn to a predetermined level, for example, from the first level to the predetermined level, or from the second level to the predetermined level. In addition, the transmittance of the display region 41 is determined according to the levels of the source signals S1-Sn. Since different display panels 40 own different characteristics, different display panels 40 have different voltage versus transmittance curves. While controlling the display region 41 to display the image, the source driving circuit 10 may be set according to the voltage versus transmittance curve for outputting source signals with levels suitable for the characteristics of the display panel 40 and thus the display region 41 displaying expected grayscales. In the following, the selection for the predetermined level will be described in detail.

The transistors M1, M2 in each pixel 42 are connected in series and coupled to a liquid-crystal capacitor LC and a storage capacitor CS. The liquid-crystal capacitor LC and the storage capacitor CS are connected in parallel and coupled to a common electrode COM. The voltage of the liquid-crystal capacitor LC controls the rotation of liquid crystals. The storage capacitor CS stores a storage voltage for maintaining the voltage of the liquid-crystal capacitor LC. Besides, in addition to coupling to the common electrode COM for receiving the common signal, the liquid-crystal capacitor LC and the storage capacitor CS may be coupled to a ground.

The transistors M, M2 of each pixel 42 are coupled to the gate signals VG1-VGn+1 and the source signals S1-Sn, respectively. Each of the gate signals VG1-VGn+1 scans at least one row of the pixels 42. Each of the source signals S1-Sn is transmitted to at least one column of the pixels 42.

According to the embodiment in FIG. 1, each of the gate signals VG1-VGn+1 scans two rows of pixels 42. The display driving circuit comprises a timing control circuit 30, which is coupled to the source driving circuit 10 and the gate driving circuit 20 and generates a plurality of timing signals St, Gt for controlling the timing of the source driving circuit 10 and the gate driving circuit 20. According to the embodiment, the gate signal VG1 controls the transistors M1 of the first-row pixels 42 and the gate signal VG2 controls the transistors M2 of the first-row pixels 42. Alternatively, the gate signal VG1 controls the transistors M2 of the first-row pixels 42 and the gate signal VG2 controls the transistors M1 of the first-row pixels 42. The control purpose is not limited by the embodiment. The gate signals VG2, VG3 received by the second-row pixels 42 are not limited to controlling the transistor M1 or transistor M2. In addition, because the pixels 42 on each row are controlled by two gate signals, the n-th-row pixels 42 are controlled by the gate signals VGn, VGn+1.

Please refer again to FIG. 1. The gate signals VG1, VG2 switch the transistors M1, M2 of the first-row pixels 42; the gate signals VG2, VG3 switch the transistors M1, M2 of the second-row pixels 42. In other words, the pixels 42 on each row may be controlled by two gate signals and one of the two gate signals (such as VG2) may control two rows of pixels 42. According to the embodiment, the level of the gate signal VG1 is the turn-on level (enable level, such as a high level) for turning on the transistor M. After the level of the gate signal VG1 is maintained at the turn-on level for a period, the level of the gate signal VG2 becomes the turn-on level for turning on the transistor M2. That is to say, the levels of the gate signals VG1, VG2 are changed to the turn-on level at different times. When both the levels of the gate signals VG1, VG2 are the turn-on level, namely, when a portion of the turn-on periods of the gate signals VG1, VG2 overlaps, the states of the transistors M1, M2 on the first-row pixels 42 are the turn-on state for transmitting the source signals S1-Sn. When the level of the gate signal VG2 is the turn-on level, although the states of the transistors M1 of the second-row pixels 42 are the turn-on state, since the level of the gate signal VG3 is the turn-off level (disable level), namely, the states of the transistors M2 of the second-row pixels 42 are the turn-off state, the second-row pixels 42 are maintained at displaying the previous image.

Next, before the level of the gate signal VG2 is changed to the turn-off level, the level of the gate signal VG1 is changed from the turn-on level to the turn-off level. In addition, the level of the gate signal VG3 is changed from the turn-off level to the turn-on level. Thereby, the states of the transistors M1, M2 of the second-row pixels 42 are the turn-on state, enabling the transistors M1, M2 to transmit the source signals S1-Sn. Afterwards, before the level of the gate signal VG3 becomes the turn-off level, the level of the gate signal VG2 is changed form the turn-on level to the turn-off level. Namely, the levels of the gate signals VG1-VGn+1 are changed from the turn-off level to the turn-on level and from the turn-on level to the turn-off level at different times. In addition, a portion of the turn-on periods of two or more gate signals, such as VG1 and VG2, or VG2 and VG3, overlaps.

Furthermore, to avoid shift in operating curves, such as variations in the threshold voltage (VT), due to long-term identical stress on the transistors M1, M2, after the display region 41 updates image, the levels of the gate signals VG1-VGn+1 received by the pixels 42 on each row may be changed to the turn-on level and to the turn-off level subsequently for changing the states of the transistors M1, M2. The number of transition for the states of the transistors M1, M2 may be determined according to design requirements. Thereby, the transistors M1, M2 may be controlled to sustain different stress alternately and thus reducing aging of the transistors M1, M2. This is the control method for de-stress. During the de-stress control period after the display region 41 updates image, the transistors M1, M2 of the pixels 42 on each row won't be turned on concurrently. The switching of the transistors M1, M2 may be controlled directly by the turn-on level, the turn-off level, or other voltage levels of the gate signals VG1-VGn+1. The embodiment is not limited to the voltage levels.

When leakage currents occur on the transistors M1, M2 and making the storage voltage of the storage capacitors CS decrease gradually, the technology for reducing the leakage current of the transistors M1, M2 as described above may be applied in the de-stress period, namely, after the display region 41 update image and before updating the next one. In other words, while controlling the transistors M1, M2 for de-stress, the source driving circuit 10 adjusts the levels of the source signals S1-Sn for reducing the influence of leakage current of the transistors M1, M2 to the transmittance (brightness) of the display region 41. Nonetheless, the display driving circuit may selectively include the de-stress technology and/or the leakage-current reduction technology. The leakage-current reduction method for the display driving circuit according to the present invention may be applied not only to the de-stress architecture but also the display panels without the de-stress architecture, namely, the single-transistor architecture of pixel.

The display driving circuit may comprise a gamma circuit 11. As shown in FIG. 1, the gamma circuit 11 may be disposed outside the source driving circuit 10. Nonetheless, the embodiment is not limited to the disposal. The gamma circuit 11 generates a plurality of gamma voltages, which may include a black grayscale voltage Vga1 and a white grayscale voltage Vga2. Besides, the gamma circuit 11 may match different display devices to generate more grayscale voltages. The present invention does not limit the design scope of the gamma circuit 11. The source driving circuit 10 is coupled to the gamma circuit 11 and outputs the source signals S1-Sn according to the gamma voltages. Namely, the source driving circuit 10 outputs the source signals S1-Sn according to the white grayscale voltage Vga2 for controlling the optical transmittance of the display region 41 to be a first transmittance (namely, first brightness). Alternatively, the source driving circuit 10 outputs the source signals S1-Sn according to the black grayscale voltage Vga1 for controlling the optical transmittance of the display region 41 to be a second transmittance (namely, second brightness). The optical transmittance of the display region 41 influences the brightness of the displayed image. Thereby, when the optical transmittance of the display region 41 is controlled to be the first transmittance, the brightness of the image is the first brightness; when the optical transmittance of the display region 41 is controlled to be the second transmittance, the brightness of the image is the second brightness. Accordingly, the source driving circuit 10 generates the source signals S1-Sn with different levels according to different grayscale voltages. For example, when the levels of the source signals S1-Sn are the first level, the brightness of the image displayed in the display region 41 is the first brightness (for example, displaying white); when the levels of the source signals S1-Sn are the second level, the brightness of the image displayed in the display region 41 is the second brightness (for example, displaying black). In other words, the brightness displayed in the display region 41 is related to the level of the grayscale voltage.

Figure 2:
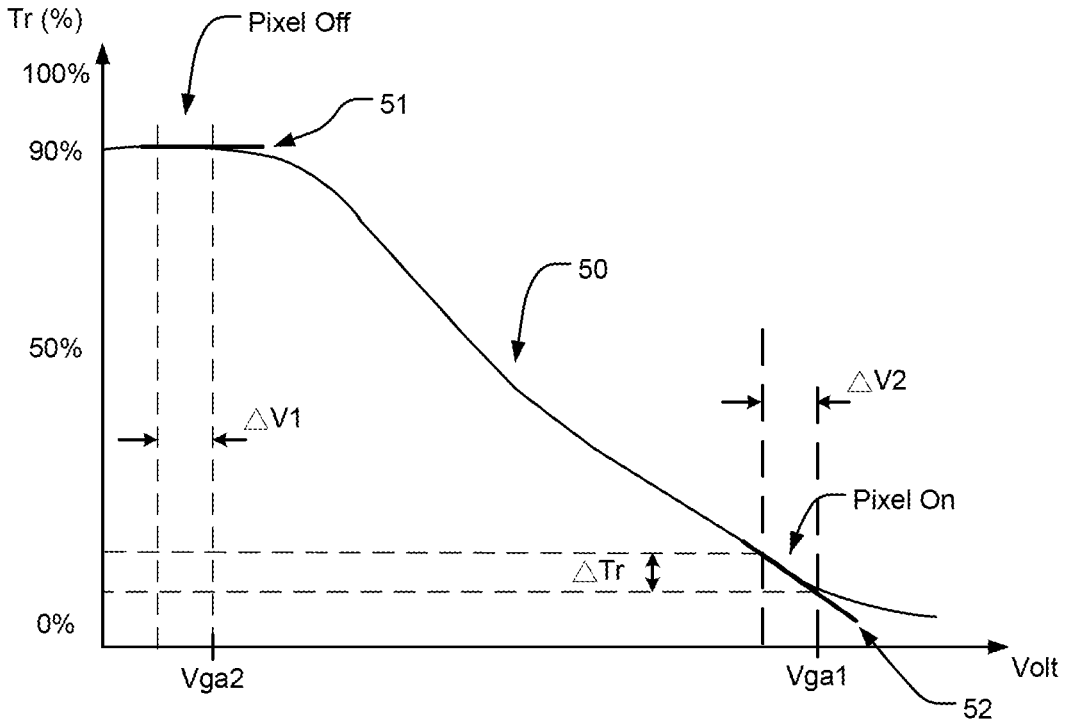
FIG. 2 shows a curve of voltage versus transmittance when the display region is in the normally white mode according to an embodiment of the present invention.

Please refer to FIG. 2, which shows a curve of voltage versus transmittance when the display region is in the normally white mode according to an embodiment of the present invention. As shown in the figure, for the display region 41 with the normally white property, the levels of the source signals S1-Sn may be the first level or the second level. Thereby, the storage voltage of the pixels 42 correspond to the levels of the source signals S1-Sn and may be a first storage voltage and a second storage voltage with the levels of the first level (for example, the white grayscale voltage Vga2) or the second level (for example, the black grayscale voltage Vga1). When the pixel 42 stores the first storage voltage, namely, the first level of the source signal S1, the transmittance (Tr) of the display region 41 is the highest. When the pixel 42 stores the second storage voltage, namely, the second level of the source signal S1, the transmittance (Tr) of the display region 41 is the lowest. In addition, in the normally white mode of a mono display, "Pixel Off" means that the display driving circuit drives the pixel 42 to shut off and display a white image while "Pixel On" means that the display driving circuit drives the pixel 42 to turn on and display a black image. In other words, for the normally black mode, the transmittance is the lowest when the pixel 42 stores the first storage voltage; the transmittance is the highest when the pixel 42 stores the second storage voltage. Thereby, in the normally black mode of a mono display, "Pixel Off" means that the display driving circuit drives the pixel 42 to shut off and display a black image while "Pixel On" means that the display driving circuit drives the pixel 42 to turn on and display a white image. The level of the second storage voltage as described above is the voltage close to the right side of the figure and the level of the first storage voltage is close to the left side of the figure. The levels are used for description only, not for limiting to specific levels. In addition, the "first" and the "second" in the description are terms for description, not used for limiting the order of respective items.

Moreover, as shown in FIG. 2, when the pixel 42 is operated at the first level of the source signal S1 (for example, the level of the first storage voltage) and the leakage current varies the first level by, for example, a first voltage shift ΔV1, the first voltage shift ΔV1 does not result in significant variation in the first transmittance. Namely, the first transmittance is still around 90% and the variation in the first brightness is negligible. When the pixel 42 is operated at the second level of the source signal S1 (for example, the level of the second storage voltage) and the leakage current varies the second level by, for example, a second voltage shift ΔV2, the second voltage shift ΔV2 results in a transmittance variation ΔTr. In other words, the transmittance might be doubled as increased from 10% to 20%, the variation in the second brightness is larger. It means that if the source driving circuit 10 adjusts the first level and the second level of the source signal S1 and they shift in identical variation, the variation in the second brightness will be larger than the variation in the first brightness. Thereby, when the display driving circuit drives the display region 41 to display the black image, the black image will have a color shift to become a grey image.

Thereby, to avoid the influence of the second voltage shift ΔV2, which is generated by the leakage current of the transistors M1, M2, to the second brightness, the levels of the source signals S1-Sn are changed to the second level when the gate signals VG1-VGn+1 are turned off. Hence, when the pixel 42 stores the second storage voltage, since the level of the source signal, such as S1, is also the second level, namely, the level of the second storage voltage, the voltage levels on both electrodes of the transistors M1, M2 are identical (there might be some minor error between the voltage levels in a real circuit) and reducing the leakage current. In addition, when the pixel 42 stores the level of the first storage voltage, if the level of the source signal S1 is the second level, the voltage levels on both electrodes of the transistors M1, M2 are different. For example, this difference is equal to the first voltage shift ΔV1. Nonetheless, as shown in FIG. 2, the first voltage shift ΔV1 does not result in significant variation in transmittance (namely, brightness). In other words, the present invention may improve the display quality of the display region 41.

In other words, referring to the display characteristic curve of the display panel 40, namely, referring to a voltage versus transmittance curve 50, the source driving circuit 10 outputs the source signals S1-Sn with levels of the first level or the second level. Please refer to FIG. 2. At the labeled white grayscale voltage Vga2 and the black grayscale voltage Vga1, the voltage versus transmittance curve 50 includes a first tangential slope 51 (related to the variation rate of the first brightness) and a second tangential slope 52 (related to the variation rate of the second brightness). The first tangential slope 51 corresponds to the first level of the source signals S1-Sn; the second tangential slope 52 corresponds to the second level of the source signals S1-Sn. Besides, assuming that the first tangential slope 51 (related to the variation rate of the first brightness) is greater than the second tangential slope 52 (related to the variation rate of the second brightness), when the levels of the gate signals VG1-VGn+1 are the turn-off level, the levels of the source signals S1-Sn need to be changed to the predetermined level, which is determined by the first tangential slope 51. That is to say, the predetermined level is determined by the first level corresponded by the first tangential slope 51. Nonetheless, according to the embodiment of FIG. 2, the first tangential slope 51 (related to the variation rate of the first brightness) is smaller than the second tangential slope 52 (related to the variation rate of the second brightness). Thereby, when the levels of the gate signals VG1-VGn+1 are the turn-off level, the levels of the source signals S1-Sn need to be changed to the predetermined level, which is determined by the second tangential slope 52. That is to say, the predetermined level is determined by the second level corresponded by the second tangential slope 52. The source signals S1-Sn are changed to the predetermined level to make the decrease of leakage current.

Figure 3:
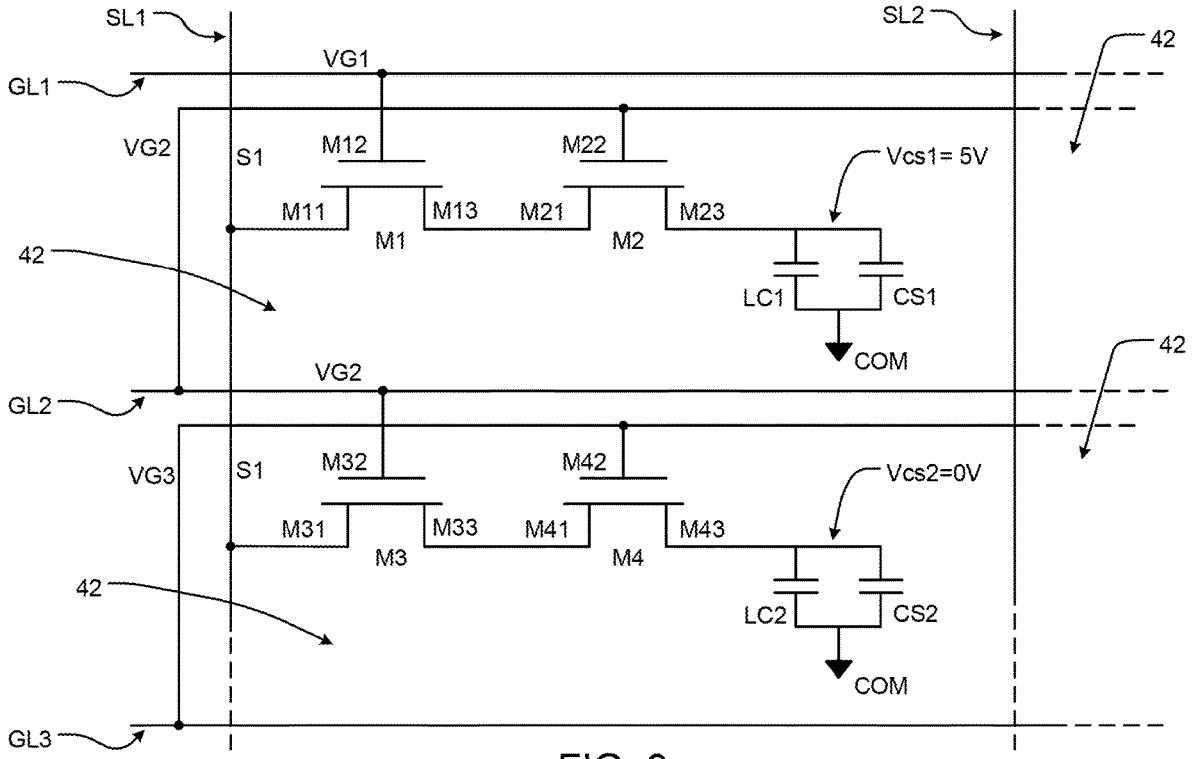
FIG. 3 shows a schematic diagram of the display driving circuit driving the pixels in the display region according to the first embodiment of the present invention.

Please refer to FIG. 3, which shows a schematic diagram of the display driving circuit driving the pixels in the display region according to the first embodiment of the present invention. According to the present embodiment, the display panel 40 with the normally white mode will be used for description. As shown in the figure, each pixel 42 of the first-row pixels 42 includes the transistors labeled M1 and M2; each pixel 42 of the second-row pixels 42 includes the transistors labeled M3 and M4. The labels M1-M4 for the transistors are used for description. In addition, in FIG. 3, only three gate lines GL1, GL2, GL3 and two source lines SL1, SL2 are illustrated for description. The transistors M1, M2 on the first row are coupled to the gate lines GL1, GL2 for receiving the gate signals VG1. VG2. The transistors M3, M4 on the second row are coupled to the gate lines GL2, GL3 for receiving the gate signals VG2, VG3. The gate signals VG1-VG3 scan all the gate lines GL1-GL3 in the display region 41. The transistors M, M3 on the first and second rows are coupled to the source line SL1 and the transistors M2, M4 are coupled to the liquid-crystal capacitors LC1, LC2 and the storage capacitors CS1, CS2, respectively. The transistors M1-M4 include first electrodes M11, M21, M31, M41, second electrodes M12, M22, M32, M42, and third electrodes M13, M23, M33, M43, respectively.

Please refer again to FIG. 3. The levels of the gate signals VG1-VG3 are the turn-on level sequentially for scanning the pixels 42 in the display region 41. Thereby, in the embodiment for a mono display, the storage capacitors CS1, CS2 of the pixels 42 store a first storage voltage Vcs1 or a second storage voltage Vcs2, respectively, when the transistors M-M4 are turned on. Thereby, when the levels of the gate signals VG1, VG2 are the turn-off level, for reducing the leakage current in the transistors M1-M4, the source driving circuit 10 controls the levels of the source signals S1-Sn to change to the level of the first storage voltage Vcs1 or the second storage voltage Vcs2 according to the influence of the voltage shifts ΔV1, ΔV2 to transmittance (refer to the voltage versus transmittance curve 50). According to the embodiment in FIG. 3, the possible levels of the source signal S1 are the first and second levels. If the gamma circuit 11 provides more other grayscale voltages, the source driving circuit 10 may adjust the levels of the source signals S1-Sn to different levels according to those grayscale voltages.

Accordingly, when the pixels 42 are in the normally white mode and the source signals S1-Sn are positive polarity, the levels of the source signals S1-Sn may be first level, which is 0V, or the second level, which is 5V. Assume that the voltage level of the first storage voltage Vcs1 of the first-row storage capacitors CS1 according to the 5V source signal S1 is 5V and the voltage level of the second storage voltage Vcs2 of the second-row storage capacitors CS2 according to the 0V source signal S1 is 0V. For a mono display, 5V and 0V are two voltage levels required for operation. Thereby, these two voltage levels are the two predetermined levels available for the source signals S1-Sn. Nonetheless, different panels may be operated by other predetermined levels. Furthermore, according to the voltage versus transmittance curve shown in FIG. 2, the level of the source signal S should be changed to the high-leveled second level. Thereby, according to the embodiment in FIG. 3, when the levels of the gate signals VG1-VG3 are the turn-off level, the source driving circuit 10 controls the level of the source signal S1 to change from 0V to the 5V predetermined level. Hence, when the levels of the gate signals VG1, VG2 of the first-row pixels 42 are the turn-off level, the voltage across the first electrode M11 of the transistor M1 and the third electrode M23 of the transistor M2 is the voltage difference between the source signal S1 and the storage voltage Vcs1, namely, the 5V predetermined level minus the 5V second level, making the voltage difference 0V. Consequently, according to the embodiment, the difference as 0V between the level of the changed source signal S and the level of the storage voltage Vcs1 of the pixel 42 is smaller than the difference as 5V between the level of unchanged source signal S1 and the level of the storage voltage Vcs1 of the pixel 42.

When the levels of the gate signals VG2, VG3 of the second-row pixels 42 are the turn-off level, the voltage across the first electrode M31 of the transistor M3 and the third electrode M43 of the transistor M4 is the voltage difference between the source signal S1 and the storage voltage Vcs2, namely, the 5V predetermined level minus the 0V first level, making the voltage difference 5V. Compared with the voltage difference of the second-row pixels 42 and the voltage difference of the first-row pixels 42, the difference between the 5V predetermined level and the 0V first level is greater than the difference between the 5V predetermined level and the 5V second level. In addition, the first electrode M11 of the transistor M1 and the third electrode M23 of the third electrode are almost on the same voltage level. Thereby, the leakage current in the transistors M1, M2 may be lowered, which lowers the variation of the transmittance (brightness). Moreover, although the first electrode M31 of the transistor M3 and the third electrode M43 of the third electrode M43 are on different voltage levels and have leakage currents, according to the voltage versus transmittance curve 50 shown in FIG. 2, the influence of the first voltage shift ΔV1 on transmittance (brightness) is smaller. Thereby, the display quality of the overall display region 41 may be improved.

Besides, as described in the previous embodiment, given the condition of not influencing the operation of reduced leakage current, the gate signals VG1-VGn+1 may switch the states of the transistors M1-M4. In other words, the level of each of the gate signals VG1-VGn+1 may be the turn-off level at different times for turning off one of the transistors M1-M4 (for example, M1, M2, M3, or M4) of the pixels 42, respectively, for preventing the transistors M1-M4 from enduring the identical stress and thus reducing shifts in the operating curves of the transistors M1-M4.

Figure 4:
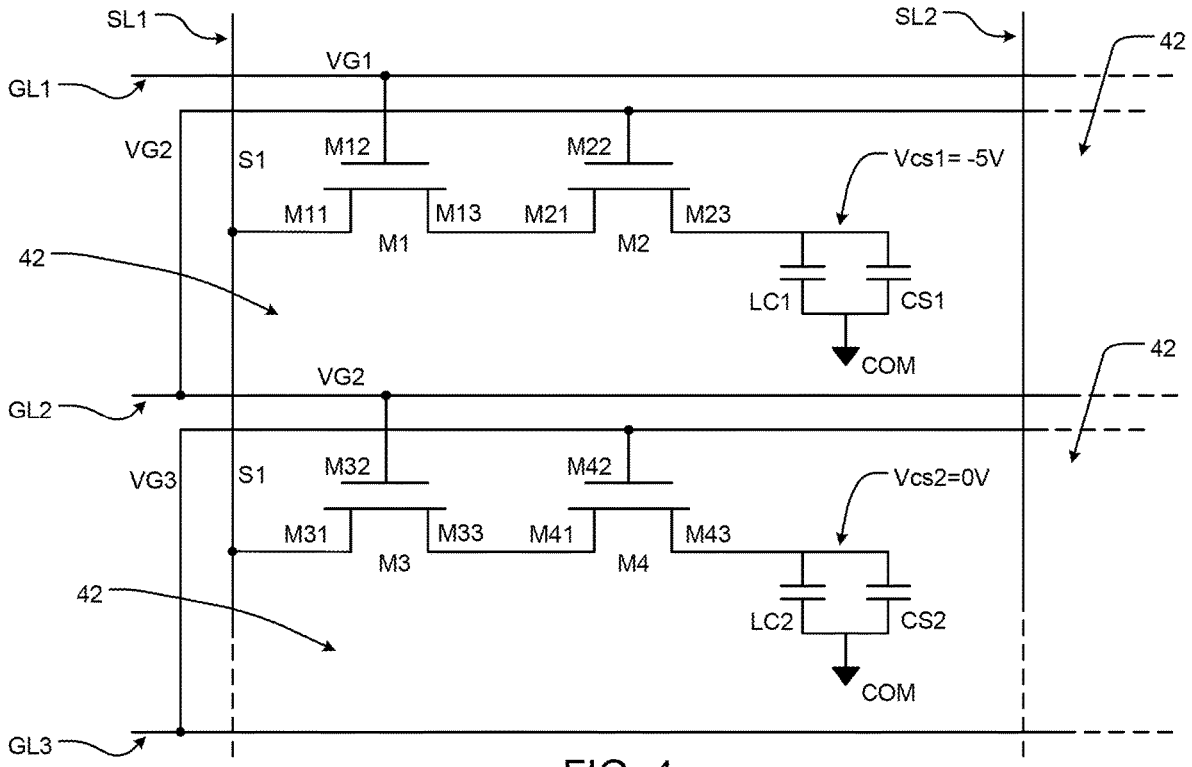
FIG. 4 shows a schematic diagram of the display driving circuit driving the pixels in the display region according to the second embodiment of the present invention.

Please refer to FIG. 4, which shows a schematic diagram of the display driving circuit driving the pixels in the display region according to the second embodiment of the present invention. According to the present embodiment, the display panel 40 with the normally white mode will be used for description. As shown in the figure, the pixels 42 are in the normally white mode and the source signals S1-Sn are negative polarity due to polarity inversion. Thereby, the storage voltage Vcs1 may be −5V and the storage voltage Vcs2 is 0V. In addition, referring to the embodiment in FIG. 2, when the levels of the gate signals VG1-VG3 are the turn-off level, the level of the source signal S1 is changed to −5V. Hence, the voltage across the first electrode M11 of the transistor M1 and the third electrode M23 of the transistor M2 is −5V minus −5V, making the voltage difference 0V. Besides, the voltage across the first electrode M31 of the transistor M3 and the third electrode M43 of the transistor M4 is 0V minus 5V, making the voltage difference 5V.

In FIG. 3 and FIG. 4, as the display frequency is lower, the accumulated charges due to leakage current become more, leading to the levels of the voltage shifts ΔV1, ΔV2 higher. In other words, if the display frequency is lowered, the period for displaying the same image is longer, and hence the levels of the voltage shifts ΔV1, ΔV2 become higher. Consequently, the levels of the storage voltage Vcs1, Vcs2 will be reduced gradually owing to the voltage shifts ΔV1, ΔV2 and making the colors displayed by the pixels 42 different from the predetermined colors. The variations of the voltage shifts ΔV1, ΔV2 may be expressed as follows:

$$\Delta V = \frac{I_{leakage} * t}{C}$$

where ΔV is the voltage shift; $I_{leakage}$ is the leakage current; t is time; and C is the capacitance value. Thereby, when the display frequency of the display device is 1 Hz or 10 Hz, or while maintaining the same image for a long time, such as an electronic tag, the storage voltages Vcs1, Vcs2 will be reduced gradually due to the voltage shifts ΔV1, ΔV2 in the period of maintaining the initial voltages (for example, the voltages stored in the liquid-crystal capacitors LC1, LC2) of the pixels 42 and may be expressed as follows:

$$Vcs1=Vlc1-\Delta V1$$

$$Vcs2=Vlc2-\Delta V2$$

where Vcs1 and Vcs2 are the storage voltage; Vlc1 and Vlc2 are the liquid-crystal voltages stored in the liquid-crystal capacitors LC1, LC2; and ΔV1, ΔV2 are the voltage shifts.

Figure 5:
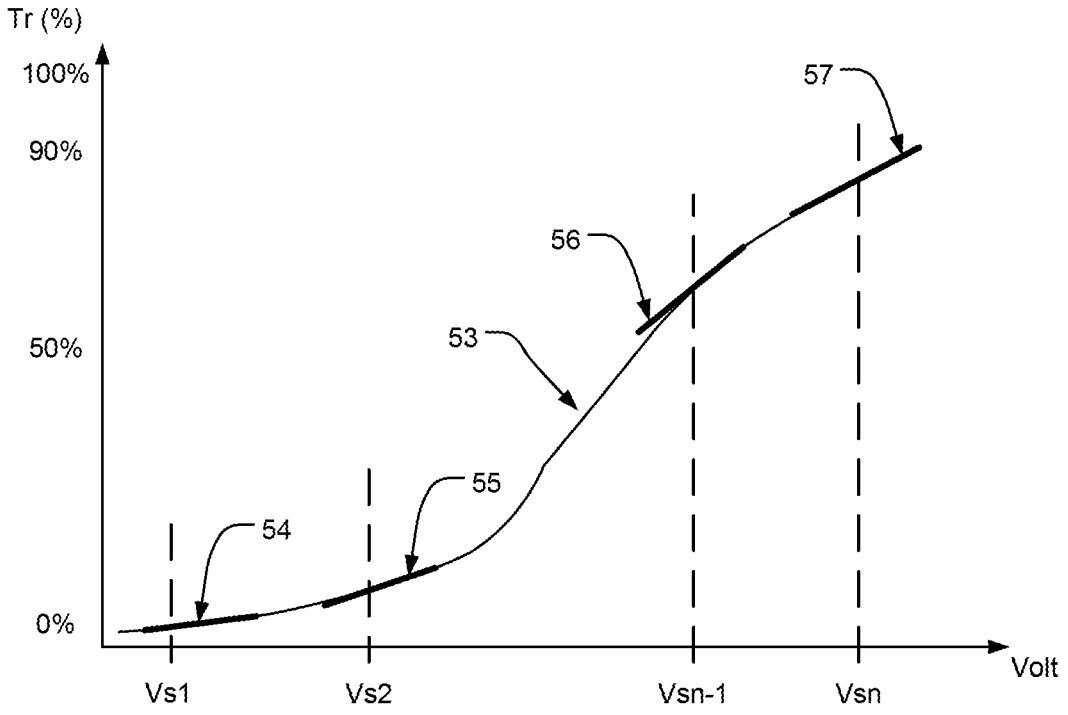
FIG. 5 shows a curve of voltage versus transmittance when the display region is in the normally black mode according to an embodiment of the present invention.

Please refer to FIG. 5, which shows a curve of voltage versus transmittance when the display region is in the normally black mode according to an embodiment of the present invention. As shown in the figure, for a display panel 40 displaying 256 grayscales, the gamma circuit 11 of the display driving circuit may be designed to generate a plurality of grayscale voltages Vs1, Vs2 . . . Vsn−1, Vsn and the display region 41 own the property of the normally black mode. Thereby, the source driving circuit 10 is coupled to the gamma circuit 11 and outputs the source signals S1-Sn according to the grayscale voltage Vs1-Vsn for controlling the display region 41 to have a plurality of optical transmittance rates, namely, a plurality of brightness values or a plurality of grayscale levels. In other words, according to the embodiment of a non-mono display panel 40, the source driving circuit 10 may output the source signals S1-Sn with different levels according to the voltage versus transmittance curve 53. Besides, as illustrate in FIG. 5, the voltage versus transmittance curve 53 includes a plurality of tangential slopes 54, 55, 56, 57 (related to a plurality of variations rates in brightness). Each of the tangential slopes 54-57 corresponds to the level of each of the grayscale voltages Vs1-Vsn. The level of each of the grayscale voltage Vs1-Vsn corresponds to different transmittance. Thereby, each of the tangential slopes 54-57 corresponds to different transmittance. In other words, each of the tangential slopes 54-57 corresponds to a level (such as the grayscale voltage Vs1) and a transmittance rate, respectively. Furthermore, the source driving circuit 10 adjusts the levels of the source signals S1-Sn according to the grayscale voltages V1-Vsn. Thereby, the tangential slopes 54-57 correspond to the levels of the source signals S1-Sn, respectively. When the levels of the gate signals VG1-VGn+1 are the turn-off level, the predetermined levels of the source signals S1-Sn are determined by the tangential slopes 54-57 and the levels corresponded by the tangential slopes 54-57. According to the embodiment in FIG. 5, the greatest tangential slope among the four tangential slopes 54-57 is the tangential slope 56. Likewise, according to the embodiment in FIG. 2, those tangential slopes 51-52 are that the tangential slope 52 is greater than the tangential slope 51. A greater tangential slope means that the influence of the voltage variation on transmittance is greater. In other words, the predetermined level of the positive source signal S1 according to the embodiment in FIG. 3 is determined by the tangential slope 52 and the level of the grayscale voltage Vga1 corresponded by the tangential slope 52, for example, 5V; the predetermined level of the negative source signal S1 according to the embodiment in FIG. 4 is determined by the tangential slope 52 and the level of the grayscale voltage Vga1 corresponded by the tangential slope 52, for example, −5V.

Alternatively, according to the voltage versus transmittance curve 53 in FIG. 5, when the levels of the gate signals VG1-VGn+1 are the turn-off level, the source driving circuit 10 may adjust the levels of the source signals S1-Sn according to a plurality of adjusting coefficients k1, k2 . . . kn−1, kn, the tangential slopes 54-57, and the levels of the grayscale voltages Vs1-Vsn−1 corresponded by the tangential slopes 54-57. The adjusting coefficients k1-kn may be set to correspond to each of the grayscale voltages Vs1-Vsn−1. For example, the first adjusting coefficient k1 of the adjusting coefficients k1-kn corresponds to the first grayscale voltage Vs1 and becomes 1/256, as shown below:

$$k1=\frac{\text{The } n\text{-}th \text{ grayscale}}{\text{Total Grayscale Number}}=\frac{Vs1}{256}=\frac{1}{256}$$

Nonetheless, the embodiment does not limit the method for setting the adjusting coefficients k1-kn. In other words, the adjusting coefficients k1-kn may correspond to other parameters related to the display quality. For example, k1-kn are all equal to 1/256.

When the levels of the gate signals VG1-VGn+1 are the turn-off level, the display driving circuit may calculate the level of a grayscale voltage to be the predetermined level according to all the tangential slopes 54-57, all the grayscale voltages Vs1-Vsn, and all the adjusting coefficients k1-kn for controlling the levels of the source signals S1-Sn to change to the predetermined level and improving the display quality of the display regions 41 by reducing the problem of color inconsistency. The grayscale voltage given by calculation may be selected to be the one closer to one of grayscale voltages Vs1, Vs2 . . . Vsn−1, Vsn, or selected to be other grayscale voltage not among the grayscale voltage levels Vs2 . . . Vsn−1 that are between the first grayscale voltage Vs1 and the last grayscale voltage Vsn. The above description may be expressed as follows:

$$Vsm=Vs1\cdot S54\cdot k1+Vs2\cdot S55\cdot k2+\ldots Vsn-1\cdot S56\cdot kn-1+Vsn\cdot S57\cdot kn$$

where Vsm is the predetermined level; Vs1-Vsn are the grayscale voltage generated by the gamma circuit 11; S54-S57 are the tangential slopes 54-57, and k1-kn are the adjusting coefficients. The predetermined voltage determined according to the above method may be determined first and set in the display driving circuit, for example, setting the source driving circuit 10 via a register.

To sum up, the present invention relates to a display driving circuit, which comprises a gate driving circuit and a source driving circuit. The gate driving circuit outputs a plurality of gate driving signals. The source driving circuit outputs a plurality of source signals and changes the levels of the source signals when the levels of the gate signals are a turn-off level.

The invention claimed is:

1. A display driving circuit, comprising:

a gate driving circuit outputting a plurality of gate signals; and a source driving circuit outputting a plurality of source signals, and changing a plurality of levels of said source signals when a plurality of levels of said gate signals are a turn-off level;

wherein said source driving circuit changes said levels of said source signals to a predetermined level when said levels of said gate signals are said turn-off level; said predetermined level is determined by a voltage versus transmittance curve; said voltage versus transmittance curve has a first tangential slope and a second tangential slope; said first tangential slope corresponds to a first level; said second tangential slope corresponds to a second level; said second tangential slope is greater than said first tangential slope; and said predetermined level is determined by said second level.

2. The display driving circuit of claim 1, wherein said level of each said source signal is a first level or a second level; said first level corresponds to a first brightness; said second level corresponds to a second brightness; a variation of said second brightness is greater than a variation of sad first brightness when a variation of said first level and a variation of said second level are identical; said source driving circuit changes said levels of said source signals to a predetermined level when said levels of said gate signals are said turn-off level; and a difference between said predetermined level and said first level is greater than a difference between said predetermined level and said second level.

3. The display driving circuit of claim 1, comprises:

a gamma circuit generating a plurality of gamma voltages, in which said source driving circuit is coupled to said gamma circuit and outputs said source signals according to said gamma voltages.

4. The display driving circuit of claim 1, wherein said gate driving circuit is coupled to a plurality of transistors of each pixel on a display panel; said gate signals control said transistors of each said pixel; and each said gate signal turns off one of said transistors of each said pixel when said level of each said gate signal is said turn-off level.

5. The display driving circuit of claim 1, wherein said gate driving circuit outputs said gate signals to a plurality of pixels in a display region of a display panel.

6. The display driving circuit of claim 1, wherein said source driving circuit outputs said source signals to a plurality of pixels for enabling said pixels to have a storage voltage, respectively; said source driving circuit changes said levels of said source signals when said levels of said gate signals are said turn-off level; and a difference between said source signals after changed and said storage voltage of at least one of said pixels is smaller than a difference between said source signals before changed and said storage voltage of at least one of said pixels.

7. The display driving circuit of claim 6, wherein said level of each said source signal is a first level or a second level; said first level corresponds to a first brightness; said second level corresponds to a second brightness; a variation of said second brightness is greater than a variation of sad first brightness when a variation of said first level and a variation of said second level are identical; and said level of said source signal received by said at least one of said pixels is said second level.

8. A display driving circuit, comprising:

a gate driving circuit outputting a plurality of gate signals; and a source driving circuit outputting a plurality of source signals, and changing a plurality of levels of said source signals when a plurality of levels of said gate signals are a turn-off level;

wherein said source driving circuit changes said levels of said source signals to a predetermined level when said levels of said gate signals are said turn-off level; said predetermined level is determined by a voltage versus transmittance curve; said voltage versus transmittance curve has a plurality of tangential slopes; each said tangential slope corresponds to a level and a transmittance, respectively; and said predetermined level is determined by said tangential slopes and said levels corresponded by said tangential slopes.

9. A display driving circuit, comprising:

a gate driving circuit outputting a plurality of gate signals; and a source driving circuit outputting a plurality of source signals, and changing a plurality of levels of said source signals when a plurality of levels of said gate signals are a turn-off level;

wherein said source driving circuit changes said levels of said source signals to a predetermined level when said levels of said gate signals are said turn-off level; said predetermined level is determined by a voltage versus transmittance curve; said voltage versus transmittance curve has a plurality of tangential slopes; each said tangential slope corresponds to a level and a transmittance, respectively; and said predetermined level is determined by at least one coefficient, said tangential slopes, and said levels corresponded by said tangential slopes.

* * * * *